United States Patent [19]

Holden

[11] Patent Number: 4,623,088

[45] Date of Patent: Nov. 18, 1986

[54] REINFORCED PACKAGING TRAY

[75] Inventor: M. James Holden, Canandaigua, N.Y.

[73] Assignee: Mobil Oil Corporation, New York, N.Y.

[21] Appl. No.: 750,316

[22] Filed: Jun. 28, 1985

[51] Int. Cl.[4] ..... B65D 1/34

[52] U.S. Cl. ..... 229/2.5 R; 206/45.33; 229/29 M

[58] Field of Search ..... 229/2.5 R, 29 M, DIG. 12; 206/45.33; 220/72; 426/124, 129, 130; D9/425, 426, 427, 428, 429, 432, 456; 99/425, 445, 446

[56] References Cited

U.S. PATENT DOCUMENTS

| | | | |
|---|---|---|---|
| D. 232,293 | 8/1974 | Christian et al. | D9/425 |
| D. 243,056 | 1/1977 | Andersson | D7/1 |
| D. 245,896 | 9/1977 | Philippon | D9/220 |
| 3,151,799 | 10/1964 | Engles, Jr. et al. | 229/2.5 R |
| 3,185,371 | 5/1965 | Reifers | 229/2.5 R |
| 3,397,068 | 8/1968 | Schaefer et al. | 156/212 |
| 3,657,044 | 4/1972 | Singer | 156/212 |
| 3,720,365 | 3/1973 | Unger | 229/2.5 R |
| 3,761,011 | 9/1973 | Reifers et al. | 229/2.5 R |
| 3,885,727 | 5/1975 | Gilley | 426/124 |
| 3,986,655 | 10/1976 | Rynning | 229/2.5 R |
| 3,997,101 | 12/1976 | Florian | 229/2.5 R |
| 4,009,817 | 3/1977 | Marshall et al. | 229/2.5 R |
| 4,057,651 | 11/1977 | Florian | 426/129 |
| 4,349,146 | 9/1982 | Holden | 229/2.5 R |
| 4,442,969 | 4/1984 | Holden | 229/2.5 R |

*Primary Examiner*—George E. Lowrance
*Assistant Examiner*—Gary E. Elkins
*Attorney, Agent, or Firm*—Alexander J. McKillop; Michael G. Gilman; Charles J. Speciale

[57] ABSTRACT

A packaging tray and, more particularly a high-strength, reinforced molded food packaging tray for use in packaging meats, fish, poultry and other comestibles which is adapted to be utilized in conjunction with a transparent overwrap film. The inventive packaging tray is provided with a novel peripheral lip structure which will aid in preventing the collapse or fracture of the tray sidewalls in view of pressures exerted by the overwrap film when applied to the tray in an automatic tray overwrap machine. In a particularly preferred embodiment of the invention, the packaging tray is provided with a novel tray bottom wall incorporating a reinforcing structure in the form of one or more strengthening ribs which are integrated in the bottom wall of the tray.

20 Claims, 10 Drawing Figures

REINFORCED PACKAGING TRAY

BACKGROUND OF THE INVENTION

1. Field of the Invention

The present invention relates to a packaging tray and, more particularly to a high-strength, reinforced molded food packaging tray for use in packaging meats, fish, poultry and other comestibles which is adapted to be utilized in conjunction with a transparent overwrap film. The inventive packaging tray is provided with a novel peripheral lip structure which will aid in preventing the collapse or fracture of the tray sidewalls in view of pressures exerted by the overwrap film when applied to the tray in an automatic tray overwrap machine. In a particularly preferred embodiment of the invention, the packaging tray is provided with a novel tray bottom wall incorporating a reinforcing structure in the form of one or more strengthening ribs which are integrated in the bottom wall of the tray.

In many modern food retailing operations, such as in supermarkets, meat and produce markets and the like, there are customarily employed many types and sizes of food trays which are usually molded from wood or paper pulp or from various plastic materials, for instance, foamed plastic, for the display and packaging of meats, fish, poultry and other produce or comestibles. Generally, these trays are relatively shallow rectangular flat-bottomed trays having outwardly inclined sidewalls, into which the commodities are placed, and thereafter a transparent heat-sealable material such as heat-shrinkable or stretchable plastic film is tightly wrapped and sealed about the tray bottom to form an attractive retail package. This type of package is extremely neat and aesthetically pleasing in appearance to a consumer, and forms a protective arrangement for the commodity contained therein while allowing the prospective customers to view its contents, so as to greatly assist in the sale of the commodities.

To a great extent, the sealing of the commodity-containing tray with the transparent overwrap film was usually effected manually by generally unskilled or semiskilled labor. Although the packages obtained in this manner are, as a rule, satisfactory in their appearance and in the quality of sealing of the commodities, the procedure was slow and cumbersome and not at all adapted to high-volume production demands.

Over the past two decades, and at an increasing percentage of the total market, there have been developed automatic tray overwrap machines which, at high rates of speed, will wrap and seal a tray containing a commodity, such as meat, fish, poultry, vegetables, or the like comestible, with a transparent overwrap film of a suitable material of the kind mentioned hereinabove. Although the automatic overwrap machines fulfill the demand for supplying wrapped trays of the type in question to a highly satisfactory degree, certain problems have been encountered in their use. Thus, the automatic overwrap machines when positioning or contacting the trays for contact with the overwrap film, and during the sealing of the film to the trays, are prone to impart relatively high forces to the sidewalls of the trays, thereby generating extremely high localized stresses which frequently cause to the tray side or end walls to buckle and fracture. This buckling may be the result of the inwardly directed forces exerted on the sidewalls of the tray due to impact by the machines and/or the surface tension imparted to the sidewalls by the overwrap film which is being applied onto the trays.

Further basic causes of tray failure when the trays are overwrapped with transparent film in automatic machines may be ascribed to poor tray design for the intended applications thereof; in essence, inadequate sidewall and tray bottom strength; incorrect design criteria in the interrelationship between the tray bottom and the upright wall structures; design of automatic equipment and the like, amongst other factors.

In essence, the failures of packaging trays while being provided with an overwrap film enclosing the comestibles on the tray in automatic tray overwrap equipment may be primarily ascribed to the following:

1. Bending or breaking at the sidewall to tray bottom transitional radius due to the concentration of inwardly or outwardly directed bending moment stresses at this point in the tray.

2. Distortion, folding or breaking of the trim lip extending about the tray resulting from the large surface film contact area of the trim flange on the tray and the high coefficient of friction between the foamed plastic tray surface with the overwrap film surface.

3. Inadequate strength and resistance to buckling of the tray bottom wall resulting from the weight of the commodity in the tray and the forces exerted thereon by the overwrap film material.

4. Bowing and resultant buckling of the trays when subjected to the wrapping forces in the equipment, and the related package instability imparted thereto by the remainder of the automated weighing/pricing/labeling equipment.

2. Discussion of the Prior Art

To some degree, the prior art has taken cognizance of the problems which are commonly encountered in the wrapping of trays with an overwrap film of the type described.

Reifers et al. U.S. Pat. No. 3,761,011 describes a food packaging tray in which the sidewalls and end walls incorporate outwardly and downwardly extending peripheral lips adapted to resist collapse of the loaded tray caused by pressure exerted by the transparent overwrap plastic film. However, the lip construction in this patent is of a rather complex configuration and would unduly increase the cost of the tray. Moreover, the Reifers tray does not appear to be constructed to withstand the high impact loads applied thereto when used in automatic tray overwrap machines.

Holden U.S. Pat. No. 4,349,146, assigned to the common assignee of the present application, discloses a molded packaging tray for the packaging of comestibles, which possesses a novel peripheral lip structure extending about the upper ends of the tray sidewalls which will aid in preventing the collapse and fracture of the sidewalls caused by pressures exerted thereon by an overwrap film when applied thereto by an automatic tray overwrap machine.

Holden U.S. Pat. No. 4,442,969, also assigned to the common assignee of the present application, pertains to a novel reinforced molded packaging tray which, in addition to a strengthened peripheral lip structure encompassing the tray sidewalls, provides for the incorporation of integral stiffening rib structure in the bottom wall of the packaging tray. This will impart further strengthening against buckling to the packaging tray, which is of particular significance to larger-sized trays, commonly referred to as family pack trays.

Although the foregoing U.S. patents, and particularly Holden U.S. Pat. Nos. 4,349,146 and 4,442,969, to a significant extent meet the needs of the industry with regard to the rapid and automated packaging of comestibles, such as meats, fish, poultry and the like, there is a need for the provision of packaging trays of this type which can satisfy the more stringent demands as to high strength which are placed on the larger sized so-called family pack trays which contain larger and resultingly heavier quantities of the commodities. This is accomplished through the provision of a novel molded packaging tray adapted for use with an overwrap film in which the peripheral lip structure on the sidewalls of the tray is configured to minimize the surface contact with the overwrap film irrespective as to whether the commodity contained in the tray exceeds or is less than the overall interior height of the packaging tray.

Pursuant to preferred embodiments of the inventive packaging tray, the latter also incorporates stiffening rib structure integrally formed in the bottom wall structure of the tray so as to still further enhance the overall strength of the packaging tray.

SUMMARY OF THE INVENTION

Accordingly, it is an object of the present invention to provide a reinforced packaging tray of the type described hereinabove which includes lip structure extending about the upper ends of the sidewalls of the tray, and which is adapted to resist forces and stresses tending to cause failure of the tray.

A more specific object of the invention resides in the provision of a reinforced molded packaging tray incorporating structure which will protect the packaging tray from fracturing or collapsing when wrapped with a transparent overwrap film in an automatic overwrap machine.

A still more specific object of the present invention resides in the provision of a tray bottom structure incorporating integral stiffening or strengthening ribs which, in cooperation with the novel tray lip structure, produces a high-strength packaging tray which is readily employable as a large-sized family pack tray for comestibles.

In order to meet the foregoing criteria and other objects, the novel lip structure which is provided for on the packaging tray sidewall periphery is of a specialized and unique configuration which is adapted to minimize surface contact between the packaging tray and the overwrap film irrespective of the type or height of the commodity contained within the packaging tray, and to concurrently avoid the generating of high localized stresses which are conducive to producing tray failure.

According to preferred embodiments of the inventive molded packaging tray, the latter is imparted a reinforcing structure through the incorporation of one or more integral strengthening ribs in the bottom wall of the tray.

The reinforced packaging tray includes the integral strengthening ribs in the tray bottom thereof, wherein the ribs are configured and arranged such that their maximum reinforcement potential for the tray is located where it is most needed and the reinforcement potential is reduced at locations where it is less needed.

The molded packaging tray pursuant to the invention has at least one integral reinforcing rib extending along the tray bottom, with each rib being tapered in height and/or width and having a maximum cross-sectional area at a centerline portion of the tray bottom and a progressively decreasing cross-sectional area as it extends away; from the centerline.

In another embodiment, the packaging tray has a plurality of integral reinforcing ribs spaced about and extending along the tray bottom, with each rib being tapered in height and/or width from a centermost portion thereof to its terminating ends.

Pursuant to another embodiment, the packaging has a flat tray bottom.

In accordance with another aspect of the invention, the thickness of the tray walls and bottom structure may be greater than in presently employed packaging trays in order to meet the demands placed thereon by the heavier loads which are supported on the trays.

BRIEF DESCRIPTION OF THE DRAWINGS

Reference may now be had to the following detailed description of preferred embodiments of the reinforced molded packaging tray of the invention, taken in conjunction with the accompanying drawings; in which.

DETAILED DESCRIPTION OF THE DRAWINGS

Figure 1:
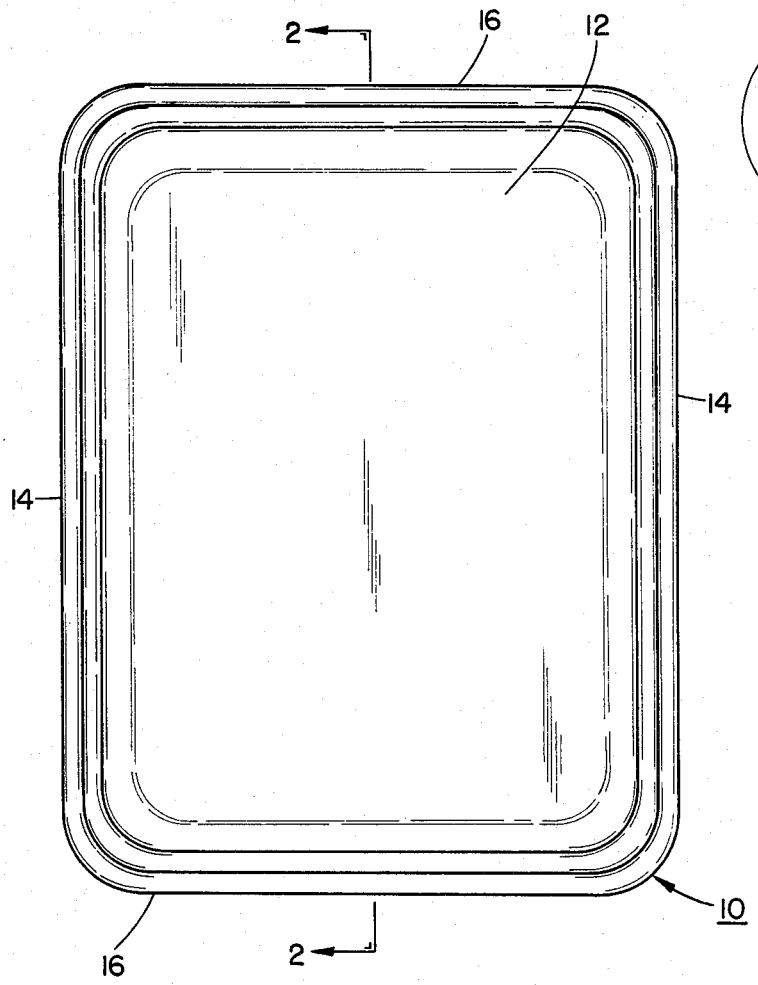
FIG. 1 illustrates a top plan view of a first embodiment of a packaging tray constructed pursuant to the invention.
Figure 2:
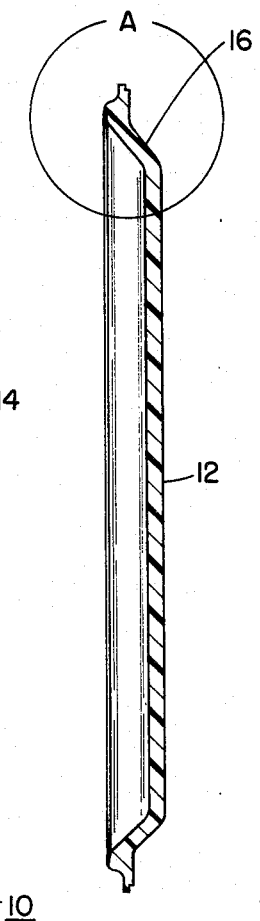
FIG. 2 is a sectional view taken along line 2—2 in FIG. 1.
Figure 3:
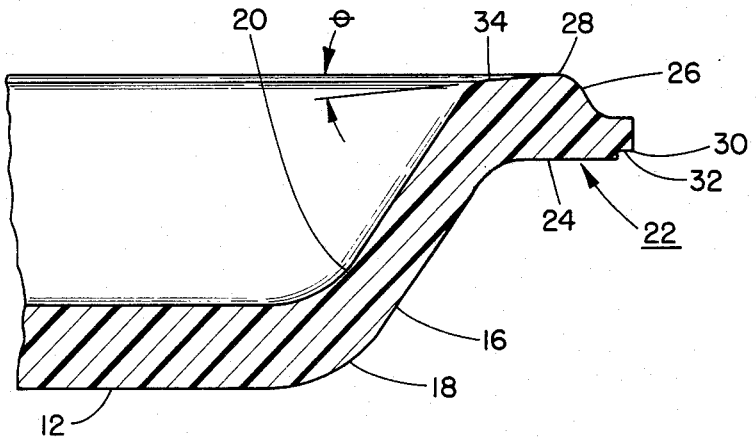
FIG. 3 is an enlarged scale sectional view of the encircled portion A in FIG. 2, illustrative of the inventive tray lip structure.
Figure 4:
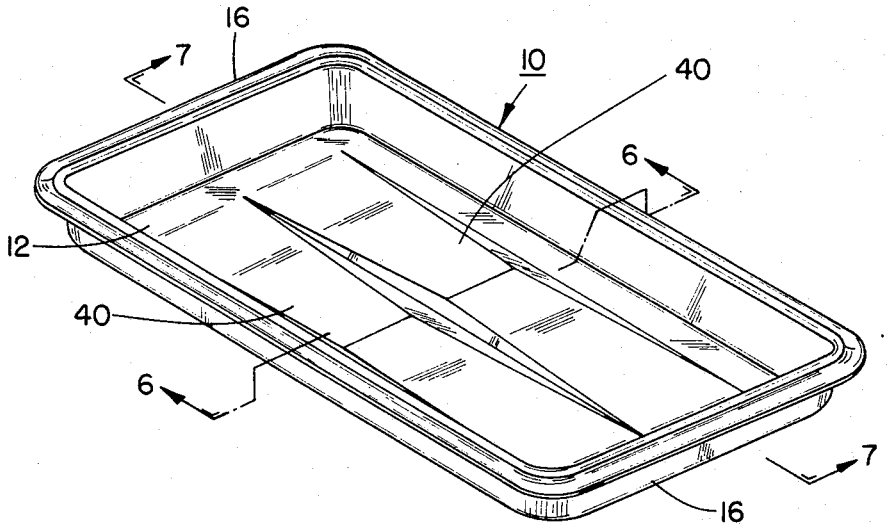
FIG. 4 is a perspective view of a second embodiment of the packaging tray pursuant to the invention.
Figure 5:
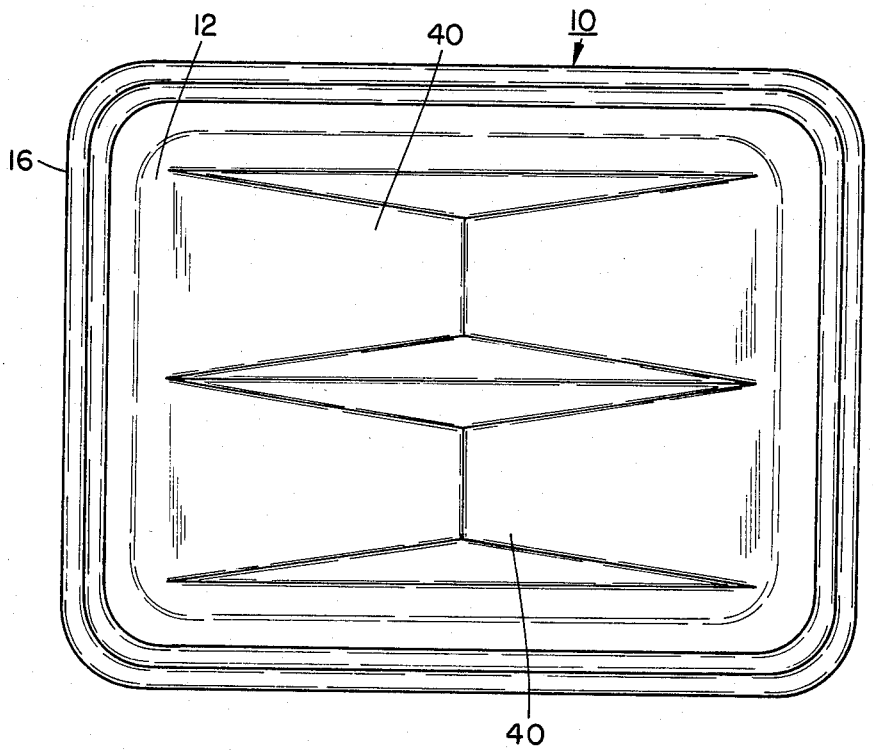
FIG. 5 is a top plan view of the packaging tray of FIG. 4.
Figure 7:
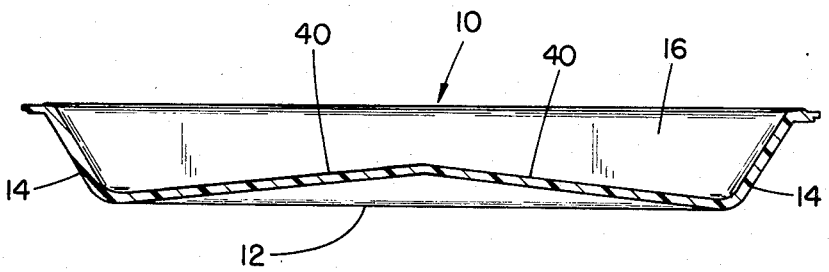
FIG. 7 is a longitudinal sectional view through one of the rib structures of the packaging tray of FIG. 4, taken along line 7—7 therein.
Figure 6:
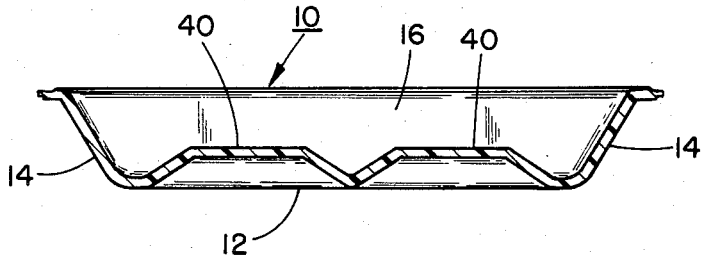
FIG. 6 is a transverse sectional view taken along line 6—6 in FIG. 4.

As shown in the drawings, and particularly the embodiment illustrated FIGS. 1 to 3, the inventive packaging tray 10 includes a flat bottom portion 12, and upwardly and outwardly inclined sidewalls 14 and 16. The tray is formed of a suitable molded pulp or foamed plastic material, as is well known in the packaging tray art. In the present instance, by way of example, the packaging tray 10 may be of the large-sized, so-called family pack tray genre, having rectangular, overall nominal trim dimensions of 10"×14", but may also be 8"×15", 8"×16", 12"×16", 9"×12", or any other combination providing a generally large tray size, an overall height of about 0.80 in., and with an internal depth of approximately 0.50 in. Quite apparently, these dimensions are only illustrative of commonly employed tray sizes, and numerous other tray sizes readily lend themselves to the present invention.

Having particular reference to the enlarged scale of FIG. 3 of the drawings, the endwalls 16, as well as sidewalls 14, all of which are referred to as sidewalls for purposes of simplicity, curve at their lower ends into the tray bottom structure 12 with large transitional radii, wherein the inner transitional radius 20 may be equal to or larger than the outer transitional radius 18 so as to enlarge the material cross-sectional thickness in this area to avoid the formation of any localized stress concentrations between the bottom of the tray and the sidewalls. The advantages of this aspect of the tray structure are described in Holden U.S. Pat. No. 4,369,146, the disclosure of which is incorporated herein by reference. Preferably, although not necessarily, the thicknesses of the sidewalls 14, 16 may be constant along their height; for example, with a wall thickness of 170 mil (0.170"). The thickness of the bottom structure of the tray may be approximately 250 mil (0.250").

Integrally formed at the upper end of the sidewalls 14, 16 is a radially outwardly extending peripheral lip structure 22 with a vertical overall thickness of about 250 mil (0.25 in.), with the lip structure having a generally flat bottom surface 24 and a reversely concave radius 26 at its upper surface 28. Extending outwardly of the lip structure 22 is a small trim lip 30 of generally rectangular cross-section which will reduce the area of contact with the overwrap film when the latter is applied by hand or on an automatic overwrap machine. The reverse trim lip radius 26 will also slightly reduce the overwrap film contact area.

Furthermore, the lower surface of the trim lip 30 has a setback 32 from the bottom surface 24. This step from the surface 32 to the surface 34 is also employed as a visual trim control guide for personnel during the manufacture of this packaging tray. Moreover, importantly, the upper end of the reversely concave radius 26 at its upper surface 28, forms a transition with a sloping planar surface 34 at the upper end of sidewalls 14, 16. This sloping planar surface 34, slopes radially outwardly and upwardly from the inner surface of the sidewalls so as to subtend an angle $\theta$ with the horizontal plane within the range of about 1° to 30°, or larger, and preferably 5°. Thus when overwrap film is applied to the upper end of the packaging tray 10, the contact areas between the tray end film and resultant stresses, are maintained at an acceptable minimum. In essence to the contact areas are limited to the upper portion of the reverse concave radius 26, the radially outer edge of the trim lip 30, and the small area below the setback 32 on the bottom surface 24. Thus, even when the contents of the tray are less than the inner height thereof, the film will not contact the sloping surface 34, thereby extensively reducing the film and tray contact areas. Preferably, the concave reverse curvature between the apex of the tray and the trim points on the trim lip represents 10 to 50% of the total tray height.

The bottom portion 12 of the packaging tray may be provided, as shown in the embodiments of FIGS. 4 to 10, with one or more upwardly extending and tapered integral reinforcing ribs 40 extending from a longitudinal centerline of the packaging tray in opposite directions towards opposing sidewalls 16 of the tray.

Thus, FIGS. 4 to 7 illustrate a preferred embodiment of the invention which employs a pair of spaced reinforcing ribs 40 extending longitudinally of a packaging tray. In this embodiment, the ribs 40 have a flat top surface forming a trapezoidal cross-sectional rib profile. The reinforcing ribs 40 taper both in height and width from the centerline of the tray along their longitudinal extent, as is readily apparent from the sectional views of FIGS. 6 and 7. In other embodiments, as the ribs 40 extend towards the sidewalls 16, they are reduced in cross-sectional area, the cross-sectional area being that area occupied by the protrusion of the rib from the surface of the tray bottom 12. The cross-sectional dimension of the ribs 40 thus tapers and decreases from the longitudinal tray centerline towards the termination of the ribs. As shown, the tapered ribs 40 preferably terminate short of the sidewalls 16.

Figure 8:
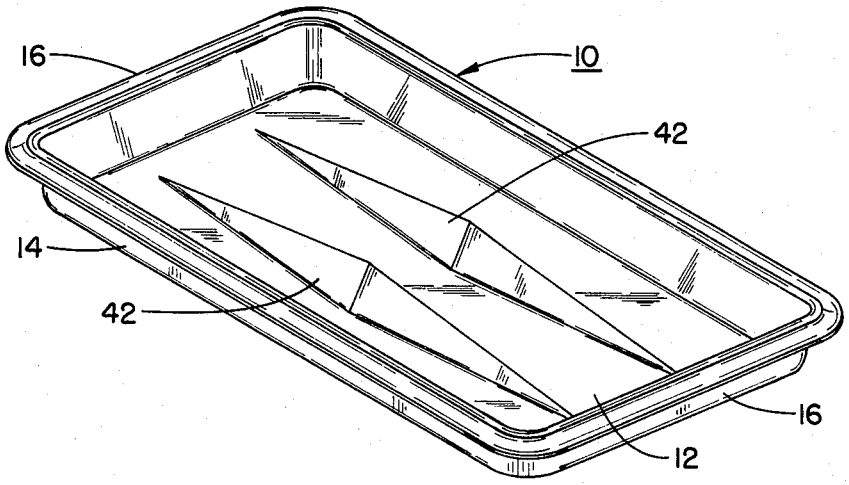
FIGS. 8 to 10 each illustrate, respectively, perspective views of further embodiments of the inventive packaging tray incorporating differently shaped and arranged tray bottom reinforcing rib structures.

The embodiment of FIG. 8 shows two ribs 42 located symmetrically about the widthwise or transverse centerline 42 of the packaging tray. However, other rib arrangements can be employed, such as a single rib extending along the longitudinal tray centerline, or three or more ribs symmetrically arranged about the centerline depending upon the tray strength which is desired.

The reinforcing ribs are preferably oriented so as to extend along the greater rectangular length direction of tray bottom 12 to accommodate the higher bending stresses acting on the tray in this direction, particularly at and in proximity to the tray center where the bending stresses are generally at a maximum. The ribs are sufficient to impart the necessary structural strength to the tray at the centermost portion along the transverse tray centerline where it is most needed.

The cross-sectional dimension of the ribs may be reduced by tapering the height and/or the width of the ribs as they approach the opposing sidewalls 16. The ribs 42 illustrated in FIG. 8 have both a height and width reduction.

Although the ribs 42 have a cross-sectional triangular profile, other profiles may be used, such as rounded, trapezoidal, rectangular shapes and the like, the important aspect being that the cross-section of the ribs decreases, as the distance increases from the centerline of the tray.

The rib construction illustrated provides the greatest degree of reinforcement at the location where it is most needed; in essence, at the longitudinal tray center and a lesser degree of reinforcement at those portions of the tray which are distant from the tray center towards the tray sidewalls 14, 16. Accordingly, the tapering ribs 40, 42 minimize their intrusion into the available volume of the packaging tray 10, and take up less space so as to provide a greater inner storage volume for food packaging.

Figure 9:
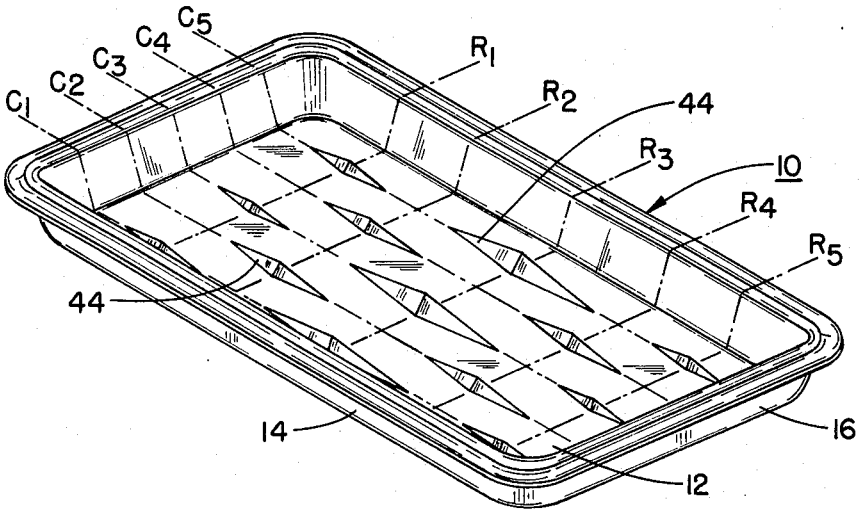

FIG. 9 illustrates an embodiment which employs a plurality of tapered ribs 44 spaced in rows $R_1 \ldots R_5$ and columns $C_1 \ldots C_5$ about the tray bottom (the rows and columns are defined when the greater longitudinal tray; dimension extends vertically). The center row of ribs is commonly bisected by the longitudinal centerline of the tray, all all of the ribs extending in the longitudinal direction of the tray bottom 12. The ribs of successive rows $R_1 \ldots R_5$ are arranged so that portions in successive rows overlap one another in the widthwise direction of the tray bottom. The ribs in the center row $R_3$ have the greatest overall dimensions (height, length, width), while those in rows $R_2$, $R_4$ and $R_1$, $R_5$ have progressively decreasing overall dimensions. Each of the illustrated ribs tapers in both height and width, but the taper may be in width or height only. Triangular profiled ribs are illustrated, however, as previously mentioned, other profiles may be employed.

Figure 10:
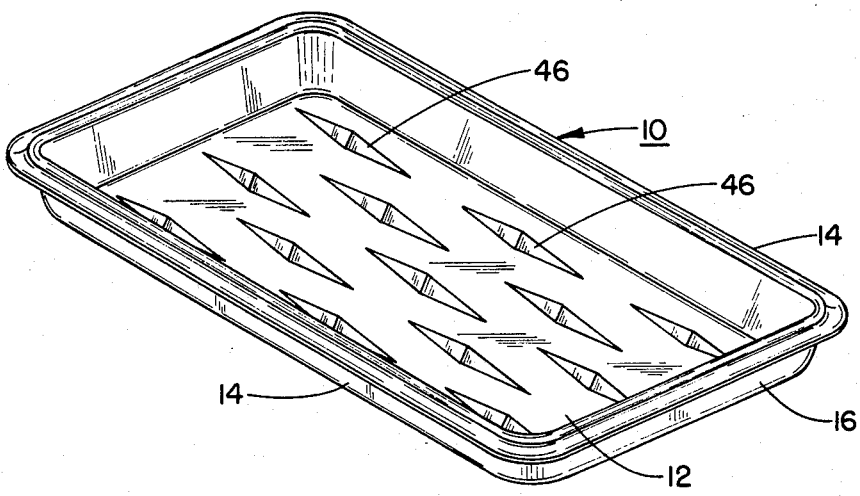

FIG. 10 illustrates an embodiment which is a variant of that illustrated in FIG. 9, in that all of the ribs 46 of the various rows $R_1 \ldots R_5$ and columns $C_1 \ldots C_5$ have the same overall dimensions.

While the tray of the present invention may be molded of conventional wood or paper pulp stock which may be formed or preformed from a water slurry, it will be understood that the construction provided is particularly suitable to the manufacture, preferably by molding, of trays from other materials, particularly foam plastic or even solid plastic. Thus, the tray of the present invention may be formed of other, equivalent materials, the structural advantages of the tray deriving from its geometry. Among other materials there may be mentioned conventional polystyrene foam, structural cellular polystyrene foam, porous polyolefin material, open cell polystyrene foam, or biodegradable foam polystyrene.

What is claimed is:

1. In a reinforced molded packaging tray for the packaging of meat, fish, poultry, comestibles or the like, for use with a transparent overwrap film extending thereabout, said tray comprising upwardly and outwardly inclined side walls forming the sides of said tray; bottom wall means including a substantially flat bottom wall for supporting said meat, fish, poultry, comestibles or the like; and a curved wall portion extending between said bottom wall and the lower ends of said sidewalls so as to provide a smoothly contoured transitional surface, the improvement wherein:

said inclined sidewalls have a radially outwardly extending lip portion extending about said side walls proximate the upper ends thereof, said lip portion having a radially outwardly and upwardly sloping planar surface extending into a concavely downwardly and outwardly curving upper surface projecting from the radially outer end of said upwardly sloping planar surface, a generally rectangular protuberance in cross-section smaller than said lip portion projecting radially outwardly of and about said lip portion so as to constitute a narrow trim lip, said trim lip having the upper surface extending from the lower outer end of said concavely curved surface and having sharp-cornered upper and lower edges, and said lip portion having a generally horizontal planar bottom surface extending outwardly of said sidewalls below the bottom plane of said trim lip and having a sharp-cornered outer edge extending into an upward planar surface joining the bottom plane of said trim lip radially inwardly of the outer face of said trim lip whereby transparent overwrap film extending about said tray lip portion will primarily contact and engage only the radially outer rounded edge on said upwardly sloping surface of the lip portion, the sharp-cornered upper and lower edges on said trim lip and the outer edge on the bottom surface of said lip portion so as to maintain a minimum surface contact between said overwrap film and said tray.

2. A reinforced molded tray as claimed in claim 1, wherein said radially outwardly and upwardly sloping planar surface on said lip portion subtends an angle within the range of about 1° to 30° with the horizontal plane.

3. A reinforced molded tray as claimed in claim 2, wherein said angle is about 5°.

4. A reinforced molded tray as claimed in claim 1, wherein the thickness of said lip portion is about 250 mil, the thickness of said sidewalls is about 170 mil, and the thickness of the tray bottom wall is about 250 mil.

5. A reinforced molded tray as claimed in claim 1, wherein said tray sidewalls have a substantially constant thickness between the tray bottom and the lip portion.

6. A reinforced molded tray as claimed in claim 1, wherein the thickness of said sidewalls is less than the thickness of said tray bottom wall and of said tray lip portion.

7. A reinforced molded tray as claimed in claim 1, wherein said bottom and sidewalls define a generally rectangular tray configuration.

8. A reinforced molded tray as claimed in claim 7, wherein the bottom of said tray includes at least one integral raised rib extending along the length of the tray, the opposite ends of said rib terminating before reaching the sidewalls adjacent said ends.

9. A reinforced molded tray as claimed in claim 8, wherein at least two of said ribs are provided extending along said bottom in parallel.

10. A reinforced molded tray as claimed in claim 9, wherein each said rib tapers in height as it extends from the centerline of the tray towards said two opposing sidewalls at the ends of the ribs.

11. A reinforced molded tray as claimed in claim 10, wherein each said rib tapers in width as it extends from said centerline towards said two opposing sidewalls.

12. A reinforced molded tray as claimed in claim 10, wherein each said rib tapers in height and width as it extends from said centerline toward said two opposing sidewalls.

13. A reinforced molded tray as claimed in claim 7, wherein the linear dimension of said bottom between said sidewalls in one direction of the tray bottom exceeds the linear dimension of said bottom between the sidewalls in the transverse direction of the tray bottom.

14. A reinforced molded tray as claimed in claim 8, wherein each said rib has a triangular cross-sectional profile.

15. A reinforced molded tray as claimed in claim 8, wherein each said rib has a trapezoidal cross-sectional profile.

16. A reinforced molded tray as claimed in claim 8, further comprising a plurality of ribs extending parallel to one another, said ribs being spaced symmetrically about a widthwise centerline of said tray.

17. A reinforced molded tray as claimed in claim 13, further comprising a plurality of tapered ribs spaced about said bottom, each of said ribs extending longitudinally in the direction of the greater linear dimension of said bottom.

18. A reinforced molded tray as claimed in claim 17, wherein said plurality of tapered ribs are arranged in rows and columns about said bottom when said tray is oriented so the greater dimension of said bottom extends vertically.

19. A reinforced molded tray as claimed in claim 18, wherein the ribs in one of said rows have their longitudinal centerlines coinciding with the longitudinal centerline of said bottom.

20. A reinforced molded tray as claimed in claim 1, wherein said tray is a flat-bottomed tray.

* * * * *